US005837649A

United States Patent [19]

Nozaki

[11] Patent Number: 5,837,649

[45] Date of Patent: Nov. 17, 1998

[54] THERMAL TRANSFER MATERIAL AND IMAGE-FORMING METHOD USING THE SAME

[75] Inventor: Takeshi Nozaki, Tokyo-to, Japan

[73] Assignee: Dai Nippon Printing Co., Ltd., Japan

[21] Appl. No.: 691,811

[22] Filed: Jul. 31, 1996

[30] Foreign Application Priority Data

Aug. 2, 1995 [JP] Japan ..... 7-215503

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 5,006,502 | 4/1991 | Fujimura et al. | 503/227 |
| 5,212,146 | 5/1993 | Komamura et al. | 503/227 |
| 5,280,005 | 1/1994 | Nakajima et al. | 503/227 |
| 5,358,922 | 10/1994 | Nakayama et al. | 503/227 |
| 5,446,012 | 8/1995 | Ito et al. | 503/227 |
| 5,457,082 | 10/1995 | Simpson et al. | 503/227 |

*Primary Examiner*—Bruce H. Hess
*Attorney, Agent, or Firm*—Parkhurst & Wendel, L.L.P.

[57] ABSTRACT

A thermal transfer material and an image-forming method using the same are provided which can form a sublimation-transferred image, on a contemplated object, having neither dropouts nor unevenness, free from bleeding, and excellent in stabilities, that is, light fastness and fixability. The thermal transfer material comprises: a substrate; and a receptive layer separably provided on one surface of the substrate, the receptive layer containing a metal ion-containing compound. The image-forming method comprises the steps of: putting a thermal transfer material, comprising a substrate and a receptive layer separably provided on one surface of the substrate, on a dye layer so that the receptive layer comes into contact with the dye layer; heating the laminate to form an image on the receptive layer; and transferring the receptive layer with an image formed thereon onto an object, wherein the receptive layer contains a metal ion-containing compound and the dye layer contains a thermal diffusible dye capable of forming a chelate.

7 Claims, 4 Drawing Sheets

THERMAL TRANSFER MATERIAL AND IMAGE-FORMING METHOD USING THE SAME

BACKGROUND OF THE INVENTION

The present invention relates to a thermal transfer material and an image-forming method using the same. In particular, the present invention relates to a novel thermal transfer material that can form an image, on an object having a surface on which an image cannot be directly formed by a thermal transfer process, the formed image having excellent storage stability, and an image-forming method using the same.

When a dye image is provided by a thermal transfer process, a special object, called an image-receiving sheet, comprising paper coated with a receptive layer composed mainly of a resin dyeable with a dye should have hitherto been provided from the viewpoint of necessity of enhancing the dying efficiency of dyes. For this reason, methods that can form an image on a desired object have been studied in the art.

One of such methods is to transfer a resin layer, dyeable with a dye, in a receptive layer onto a desired object by a thermal transfer process followed by the formation of a dye image on the transferred receptive layer.

Another method is to form a dye image on a receptive layer separably provided on a substrate followed by the transfer of the receptive layer, with an image formed thereon, onto an object.

Dyes used in the thermal transfer material are important to the thermal transfer process. Conventional dyes, however, are unfavorably poor in stability of the formed image, that is, light fastness and fixability of the formed image.

In order to improve this drawback, an image-forming method has been proposed wherein a thermal diffusible dye capable of forming a chelate is used to form a sublimation-transferred image of a dye in a chelate form on a receptive layer of an object.

In the above method wherein a resin layer, dyeable with a dye in a receptive layer, transferred onto a desired object by a thermal transfer process followed by the formation of a dye image on the transferred receptive layer, the image-receptive layer on the object is greatly influenced by the surface quality of the object. Specifically, when the surface of the object has irregularities, the surface of the image-receptive layer also has irregularities, resulting in the formation of an image having dropouts and significant unevenness.

On the other hand, in the method wherein a dye image is formed on a receptive layer separably provided on a substrate followed by the transfer of the receptive layer, with an image formed thereon, onto an object, heating conditions for transferring the receptive layer, with a dye image formed thereon, onto an object at the time of the thermal transfer recording are so severe that bleeding is likely to occur in the formed image.

Further, in the image-forming method wherein a thermal diffusible dye capable of forming a chelate is used to form a sublimation-transferred image of a dye in a chelate form on a receptive layer of an object, heating conditions for transferring a dye onto a receptive layer of an object to dye the receptive layer at the time of formation of an image cannot result in complete chelation of the thermal diffusible dye in the receptive layer. Therefore, a part of the thermal diffusible dye which has not been chelated is left in the receptive layer, posing a problem that the stabilities of the image, that is, the light fastness and fixability of the image, are poor.

Accordingly, an object of the present invention is to solve the above problems of the prior art and to provide a thermal transfer material which can form a sublimation-transferred image, on a contemplated object, having neither dropouts nor unevenness, free from bleeding, and excellent in stabilities, that is, light fastness and fixability, and an image-forming method using the same.

DISCLOSURE OF INVENTION

In order to attain the above object, the present invention provides a thermal transfer material comprising: a substrate; and a receptive layer separably provided on one surface of the substrate, the receptive layer containing a metal ion-containing compound. According to one preferred embodiment of the present invention, the metal ion-containing compound contained in the receptive layer is at least one member selected from the group consisting of compounds represented by the general formulae (1) and (3) which will be described later. According to another embodiment of the present invention, a dye layer containing a thermal diffusible dye capable of forming a chelate is provided on the surface of the substrate so as to have a side by side relationship with the receptive layer. According to a further preferred embodiment of the present invention, the thermal diffusible dye contained in the dye layer and capable of forming a chelate is at least one dye selected from the group consisting of compounds represented by the general formulae (5) and (6) which will be described later. According to a further preferred embodiment of the present invention, a release layer is provided between the substrate and the receptive layer. According to a further preferred embodiment of the present invention, a back surface layer is provided on the other surface of the substrate remote from the receptive layer.

According to another aspect of the present invention, there is provided an image-forming method comprising the steps of: putting a thermal transfer material, comprising a substrate and a receptive layer separably provided on one surface of the substrate, on a dye layer so that the receptive layer comes into contact with the dye layer; heating the laminate to form an image on the receptive layer; and transferring the receptive layer with an image formed thereon onto an object, wherein the receptive layer contains a metal ion-containing compound and the dye layer contains a thermal diffusible dye capable of forming a chelate.

The function of the present invention will be described.

A receptive layer is separably provided on one surface of the substrate. By virtue of this constitution, the formation of a sublimation-transferred image on the receptive layer, followed by heating through the other surface of the substrate remote from the receptive layer by means of a thermal head, a hot stamper or the like enables an image to be formed on any desired object in its desired place and any desired image size.

Further, the thermal diffusible dye can be completely chelated in such a manner that the metal ion-containing compound contained in the receptive layer and the thermal diffusible dye, capable of forming a chelate, contained in the dye layer are chelated with each other upon heating in the formation of a sublimation-transferred image onto the receptive layer, and the remaining thermal diffusible dye which has not been chelated is then chelated upon heating in the transfer of the image-bearing receptive layer onto an object.

BEST MODE FOR CARRYING OUT THE INVENTION

Embodiments of the present invention will be described with reference to the accompanying drawings.

Figure 1:
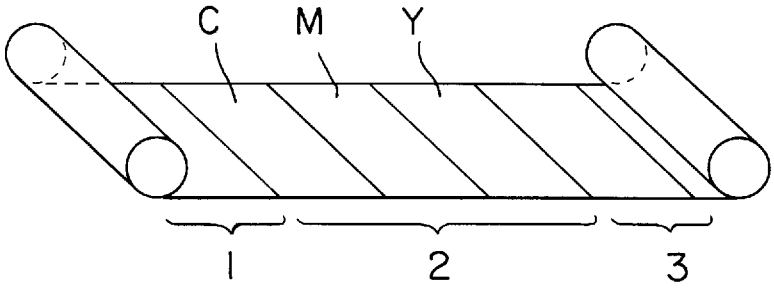
FIG. 1 is a perspective view showing an embodiment of the construction of the thermal transfer sheet according to the present invention.

FIG. 1 is a perspective view of a thermal transfer material according to one embodiment of the present invention. In FIG. 1, a receptive layer area 1, a dye layer area 2, and an adhesive layer area 3 are provided side by side on one plane of a substrate. Depending upon the type of the recording device and the recording method, the construction of the thermal transfer material may be such that only a dye layer area 2 is provided on one surface of a substrate sheet while a receptive layer area 1 and an adhesive layer area 3 are provided on the other surface of the substrate, or alternatively the construction of the thermal transfer material may be such that only a receptive layer area 1 is provided on one surface of the substrate while a dye layer area 2 and an adhesive layer area 3 are provided on the other surface of the substrate. Further, in FIG. 1, the receptive layer area 1, the dye layer area 2, and the adhesive layer area 3 are provided without any spacing between the areas. Alternatively, spacing may be provided between the areas. In this case, the spacing may be suitably determined according to the method for controlling the thermal transfer recording device. Further, the provision of a detection mark is preferred in order to accurately search out each area. There is no particular limitation on a method for providing the detection mark.

In the embodiment shown in FIG. 1, the receptive layer and the dye layer area are provided on one plane of the substrate. It is needless to say that they may be provided on respective separate substrates.

Figure 2:
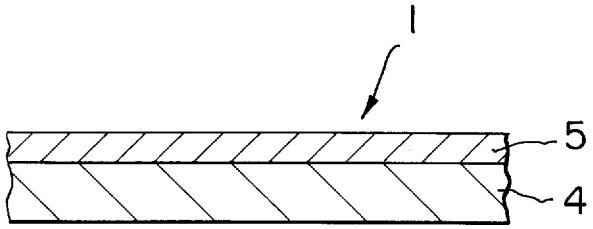
FIG. 2 is a cross-sectional view showing one embodiment of the construction of a receptive layer area.

The layer construction of the receptive layer area 1 is as shown in FIG. 2, and a receptive layer 5 is provided on one surface of a substrate 4.

Substrate

The substrate 4 is not limited to materials having microvoids, such as polyolefin or polystyrene synthetic papers, and substrates used in the conventional thermal transfer sheets as such may be used in the present invention. That is, there is no particular limitation on the material of the substrate 4. Preferred examples of the substrate 4 include thin papers, such as glassine, capacitor, and paraffin papers; stretched or unstretched plastic films of polyesters, having high heat resistance, such as polyethylene terephthalate, polyethylene naphthalate, polybutylene terephthalate, polyphenylene sulfide, polyether ketone, and polyether sulfone, polypropylene, polycarbonate, cellulose acetate, polyethylene derivatives, polyvinyl chloride, polyvinylidene chloride, polystyrene, polyamide, polyimide, polymethylpentene, and ionomers; and laminates of the above sheets. The thickness of the substrate may be properly selected, depending upon the material, so as to provide proper properties such as strength, thermal conductivity, and heat resistance. In general, however, it is preferably about 1 to 100 $\mu$m.

Receptive Layer

The receptive layer 5 is separably provided on one surface of the substrate and formed of a metal ion-containing compound and a binder resin and optional various additives such as a release agent. Preferably, the binder resin is easily dyeable with a sublimable dye. Binder resins usable herein include polyolefin resins, such as polypropylene, halogenated resins, such as polyvinyl chloride and polyvinylidene chloride, vinyl resins, such as polyvinyl acetate and polyacrylic esters, polyester resins, such as polyethylene terephthalate and polybutylene terephthalate, polystyrene resins, polyamide resins, copolymers of olefins, such as ethylene and propylene, with other vinyl monomers, ionomers, and cellulose derivatives.

In order to prevent heat fusing between the receptive layer 5 and the dye layer, it is preferred to add a release agent to the receptive layer 5. Release agents usable herein include reaction-cured silicones and phosphate ester surfactants, and fluorocompounds. Among them, reaction-cured silicones, specifically a cured product prepared by reacting a vinyl-modified silicone or an amino-modified silicone with an epoxy-modified silicone is particularly preferred. The amount of the release agent added is preferably 0.5 to 10% by weight based on the solid content of the receptive layer.

Examples of the metal-ion containing compound (hereinafter referred to as "metal source") include compounds represented by the following general formula (1):

$$M^{2+}(X)_n 2Y^- \quad (1)$$

wherein $M^{2+}$ represents a divalent transition metal ion, X represents a coordinating compound capable of coordinating to the transition metal ion $M^{2+}$ to form a complex and n is an integer of 2 or 3, provided that a plurality of coordinating compounds X may be the same or different, and $Y^-$ represents a counter ion for the transition metal ion $M^{2+}$.

In the compounds represented by the general formula (1), $M^{2+}$ represents a divalent transition metal ion. Examples of the transition metal ion include cobalt ($^{2+}$), nickel ($^{2+}$), copper ($^{2+}$), zinc ($^{2+}$), iron ($^{2+}$). Among them, nickel ($^{2+}$), copper ($^{2+}$), and zinc ($^{2+}$) are particularly preferred.

In the compounds represented by the general formula (1), $(X)_n$ represents two or three coordinating compounds capable of coordinating to the transition metal ion $M^{2+}$ to form a complex. They may be selected from coordinating compounds described, for example, in "KIRETO KAGAKU (5)" (edited by Nan'un-dou Co., Ltd.). Among others, ethylenediamine derivatives, picoline amide derivatives, 2-aminomethyl piperidine derivatives, and glycine amide derivatives are preferred, and ethylenediamine derivatives and glycine amide derivatives are particularly preferred. Examples of ethylenediamine derivatives include ethylenediamine, 1,2-diaminopropane, N-methylethylenediamine, N-ethylethylenediamine, N,N-dimethylethylenediamine, and N,N'-dimethylethylenediamine. Examples of glycine amide derivatives include compounds represented by the general formula (2):

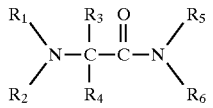

(2)

wherein $R_1$, $R_2$, $R_3$, $R_4$, $R_5$, and $R_6$ each independently represent a hydrogen atom or an alkyl, aryl, cycloalkyl, aralkyl, or heterocyclic group. In the general formula (2), $R_1$ and $R_2$, $R_1$ and $R_3$, and $R_5$ and $R_6$ may combine with each other to form a five-membered or six-membered ring. The five-membered or six-membered ring contains a nitrogen atom and represents a pyrrolidine, piperidine, or morpholine ring with pyrrolidine and piperidine rings being preferred.

Examples of the alkyl group represented by the $R_1$ to $R_6$ include straight-chain or branched alkyl groups having 1 to 8 carbon atoms, such as methyl, ethyl, propyl, isopropyl, butyl, sec-butyl, hexyl, and octyl groups. Among them, straight-chain or branched alkyl groups having 1 to 3 carbon atoms are preferred.

The aryl group represented by $R_1$ to $R_6$ is preferably a phenyl group.

The cycloalkyl group represented by $R_1$ to $R_6$ is preferably a cyclopentyl or cyclohexyl group.

The aralkyl group represented by $R_1$ to $R_6$ is preferably a benzyl group.

The heterocycle group represented by $R_1$ to $R_6$ is preferably, for example, a pyridyl group.

Each group represented by $R_1$ to $R_6$ may be optionally substituted. Examples of the substituent include alkyl groups, such as methyl, ethyl, and trifluoromethyl groups; aryl groups, such as a phenyl group; alkoxy groups, such as methoxy and ethoxy groups; amino groups, such as methylamino and ethylamino groups; acylamino groups, such as an acetyl group; sulfonyl groups, such as a methanesulfonyl group; alkoxycarbonyl groups, such as a methoxycarbonyl group; a cyano group; a nitro group; and halogen atoms, such as chlorine and fluorine atoms.

In the compounds represented by the general formula (1), $Y^-$ represents a counter anion for the transition metal ion $M^2+$. The counter anion is an organic or inorganic anion, and particularly preferred is a compound that can render a complex, of the transition metal ion $M^{2+}$ with the coordinating compound $(X)_n$, soluble in an organic solvent, for example, methyl ethyl ketone or tetrahydrofuran (THF). Specific examples of counter anions include organic salts of alkylcarboxylic acids, arylcarboxylic acids, alkylsulfonic acids, arylsulfonic acids, alkylphosphoric acids, arylphosphoric acids, and arylboric acids. Among them, organic salts of arylboric acids and arylsulfonic acids are particularly preferred.

Regarding specific examples of the compounds represented by the general formula (1), when the transition metal ion $M^{2+}$ is nickel ($^{2+}$), n is preferably 3, while when $M^{2+}$ is copper ($^{2+}$) or zinc ($^{2+}$), n is preferably 2.

Specific examples of compounds represented by the general formula (1) are as follows. "MS" is an abbreviation for "metal source."

| | |
|---|---|
| MS-1: | $[Cu(NH_2CH_2CH_2NH_2)_2]^{2+}\ [(C_6H_5)_4B]_2^-$ |
| MS-2: | $[Ni(NH_2CH_2CH_2NH_2)_3]^{2+}\ [(C_6H_5)_4B]_2^-$ |
| MS-3: | $[Co(NH_2CH_2CH_2NH_2)_3]^{2+}\ [(C_6H_5)_4B]_2^-$ |
| MS-4: | $[Zn(NH_2CH_2CH_2NH_2)_3]^{2+}\ [(C_6H_5)_4B]_2^-$ |
| MS-5: | $[Ni(C_2H_5NHCH_2CH_2NH_2)_3]^{2+}\ C_6H_5)_4B]_2^-$ |
| MS-6: | $[Ni(C_2H_5NHCH_2CH_2NHC_2H_5)_3]^{2+}\ [(C_6H_5)_4B]_2^-$ |
| MS-7: | $[Ni(NH_2CH_2CH_2NHCH_2CH_2NH_2)_2]^{2+}\ [(C_6H_5)_4B]_2^-$ |

MS-8 to MS-11

MS-8 to MS-11:

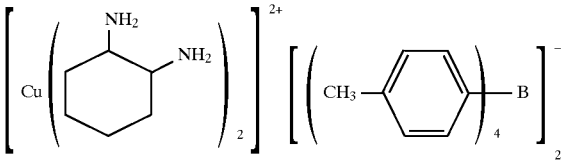

MS-8

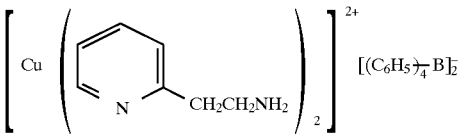

MS-9

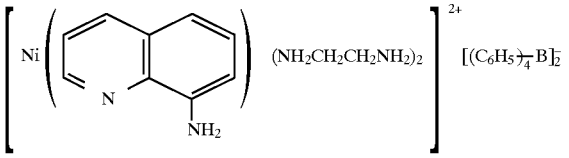

MS-10

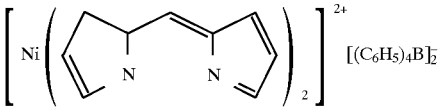

MS-11

MS-12 to MS-17:

-continued
MS-12
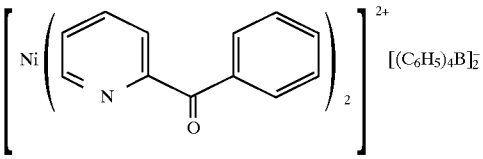
MS-13
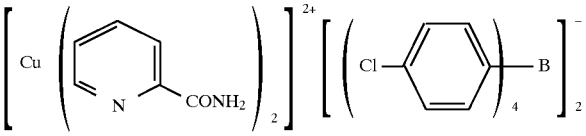
MS-14
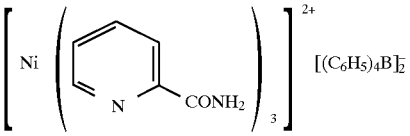
MS-15
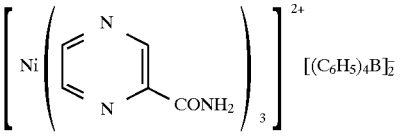
MS-16
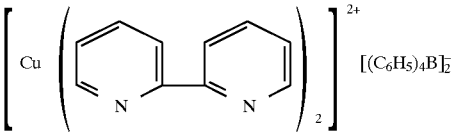
MS-17
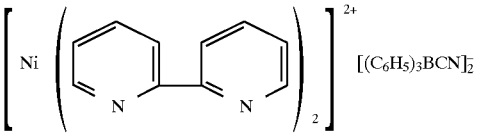
MS-18 to MS-20:
MS-18
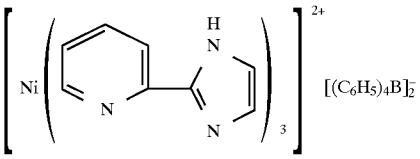
MS-19
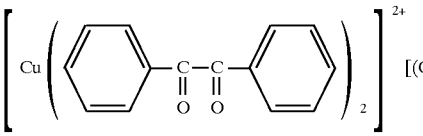
MS-20
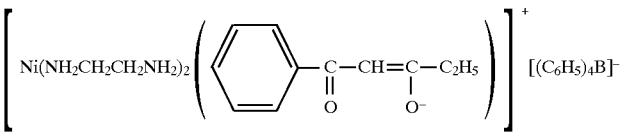
MS-21: $[Ni(NH_2CH_2CH_2CH_2NH_2)_3]^{2+}$ $[(n\text{-}C_4H_9)_4B]^-{}_2$
MS-22: $[Ni(C_2H_5NHCH_2CH_2NH_2)_2(NH_2CH_2CH_2NH_2)]^{2+}$ $[(C_6H_5)_4B]^-{}_2$ MS-23 and MS-24:
MS-23
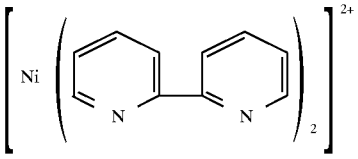
$[(C_6H_5)_4B]_2^-$
MS-24
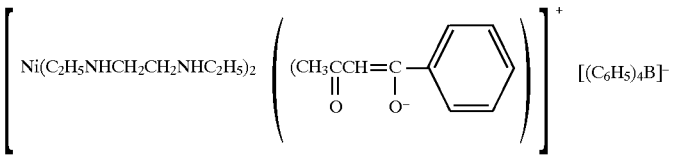
MS-25 to MS-34:
| Compd. No. | M $(X)_n$ | $Y^-$ |
|---|---|---|
| MS-25 | Ni $(H_2NCOCH_2NH_2)_3$ | 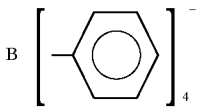 |
| MS-26 | Ni $(CH_3NHCOCH_2NH_2)_3$ | 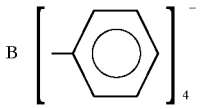 |
| MS-27 | Ni $(H_2NCOCH_2NHCH_3)_3$ | 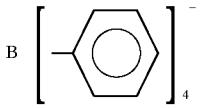 |
| MS-28 | Ni $(C_2H_5NHCOCH_2NH_2)_3$ | 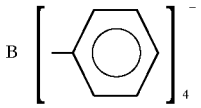 |
| MS-29 | Ni $((t)C_3H_7NHCOCH_2NH_2)_3$ | 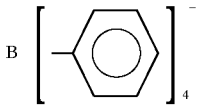 |
| MS-30 | Ni $(C_3H_7NHCOCH_2NH_2)_3$ | 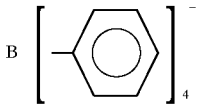 |
| MS-31 | Ni $(H_2NCOCH_2NHC_3H_7)_3$ | 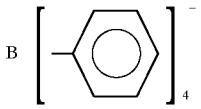 |
| MS-32 | Ni 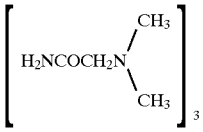 | 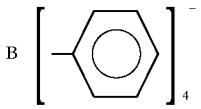 |
| MS-33 | Ni 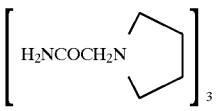 | 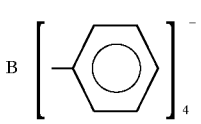 |

-continued
MS-34 Ni 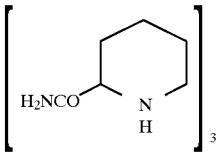 B 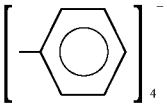
MS-35 to MS-40:
MS-35 Ni $(H_2NCOCH_2NH_2)_3$ 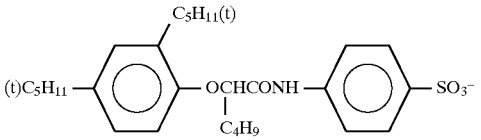
MS-36 Ni $(H_2NCOCH_2NH_2)_3$ 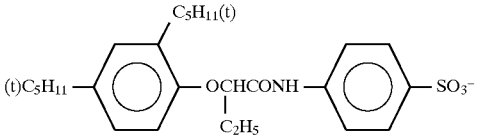
MS-37 Ni $(CH_3NHCOCH_2NH_2)_3$ 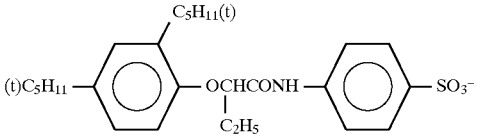
MS-38 Ni $(H_2NCOCH_2NHCH_3)_3$ 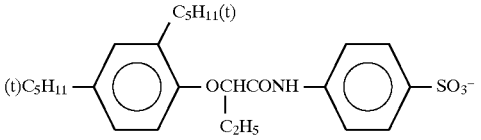
MS-39 Ni $(H_2NCOCH_2NH_2)_3$ B 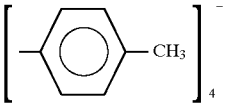
MS-40 Ni $(H_2NCOCH_2NH_2)_3$ B 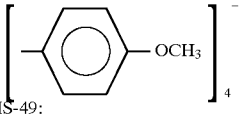
MS-41 to MS-49:
MS-41 Ni 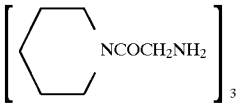 B 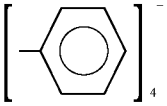
MS-42 Ni $(CH_3NHCOCH_2NHCH_3)_3$ B 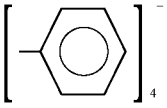
MS-43 Ni 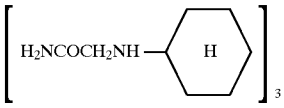 B 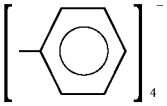
MS-44 Ni $(H_2NCOCH_2NH_2)_2CH_3NHCH_2CH_2NH_2$ B 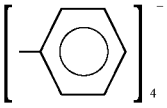
MS-45 Ni $(CH_3NHCOCH_2NH_2)_2CH_3NHCH_2CH_2NH_2$ B 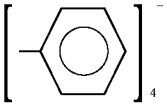

-continued

| | | |
|---|---|---|
| MS-46 | Ni $(H_2NCOCH_2NH_2)_2$ $CH_3$ \ $NCH_2CH_2NH_2$ / $CH_3$ | B [ ⟨benzene⟩ ]$^-$ 4 |
| MS-47 | Ni $(H_2NCOCH_2NHCH_3)_2CH_3NHCH_2CH_2NH_2$ | B [ ⟨benzene⟩ ]$^-$ 4 |
| MS-48 | Cu $(H_2NCOCH_2NH_2)_2$ | $C_5H_{11}(t)$; $(t)C_5H_{11}$ — ⟨benzene⟩ — OCHCONH (| $C_2H_5$) — ⟨benzene⟩ — $SO_3^-$ |
| MS-49 | Cu $(H_2NCOCH_2NH_2)_2$ | B [ ⟨benzene⟩ ]$^-$ 4 |

Preferably, the receptive layer of the present invention contains a metal source represented by the following general formula (3):

$$M^{2+}(X^-)_2 \quad (3)$$

wherein $M^{2+}$ is a divalent transition metal ion and $X^-$ is as defined above in connection with the formula (1), provided that the compound represented by the general formula (3) may have a neutral ligand depending upon the metal located in the center of the compound. Representative ligands include $H_2O$ and $NH_3$.

In the metal sources represented by the general formula (3), examples of the X include coordinating compounds represented by the following general formula (4):

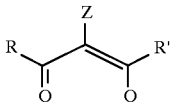

(4)

In the compounds represented by the general formula (4), Z represents an alkyl, aryl, alkoxy, acyl, alkoxycarbonyl, aryloxycarbonyl, or carbamoyl group or a halogen or hydrogen atom. Z is preferably an electron-withdrawing group, such as an aryloxycarbonyl or alkoxycarbonyl group or a halogen atom from the viewpoint of stabilizing the metal ion-donating compound. Among them, the aryloxycarbonyl and alkoxycarbonyl groups are more preferred from the viewpoint of solubility. Examples of the aryloxycarbonyl group include a phenoxycarbonyl group, and examples of the alkoxycarbonyl group include straight-chain or branched alkoxycarbonyl groups having 1 to 20 carbon atoms, such as methoxycarbonyl, ethoxycarbonyl, pentyloxycarbonyl, and 2-ethylhexyloxycarbonyl groups. These alkoxycarbonyl groups may be substituted by a halogen atom or an aryl or alkoxy group.

R and R' which may be the same or different represent an alkyl or aryl group. R and Z, or R' and Z may combine with each other to form a ring, provided that, when Z represents a hydrogen atom, R and R' are not simultaneously a methyl group. Examples of the alkyl group represented by Z, R, and R' include straight-chain or branched alkyl groups having 1 to 20 carbon atoms, such as methyl, ethyl, propyl, isopropyl, butyl, sec-butyl, t-butyl, hexyl, octyl, and 2-ethylhexyl groups. These alkyl groups may be substituted by a halogen atom or an aryl or alkoxy group. Examples of the aryl groups represented by Z, R, and R' include phenyl and naphthyl groups. These aryl groups may be substituted. Examples of the alkoxy group represented by Z include straight-chain or branched alkoxy groups having 1 to 20 carbon atoms, such as methoxy, ethoxy, and butoxy groups. Examples of the acyl group represented by Z include acetyl, propionyl, chloroacetyl, phenacetyl, and benzoyl groups. Preferred examples of the halogen atom represented by Z include a chlorine atom.

In general, the amount of the metal source used in the present invention is preferably 0.5 to 20 g, more preferably 1 to 15 g, per $m^2$ of solid content of the receptive layer.

Examples of compounds represented by the general formula (3) are as follows. However, the compounds represented by the general formula (3) are not limited to these examples only.

| Compd. No. | M | X |
|---|---|---|
| | | MS-50 to MS-53: |
| MS-50 | Ni | $CH_3$ — C(=O) — CH=CH — C(=O) — $CF_3$ |
| MS-51 | Ni | $CH_3$ — C(=O) — CH=CH — C(=O) — $C_4H_9(t)$ |
| MS-52 | Ni | $(i)C_3H_7$ — C(=O) — CH=CH — C(=O) — $CH_3$ |
| MS-53 | Ni | $CH_3$ — C(=O) — CH=CH — C(=O) — $CH_2CH(CH_3)_2$ |
| | | MS-54 to MS-60: |

-continued
| Compd. No. | M | X |
|---|---|---|
| MS-54 | Ni | 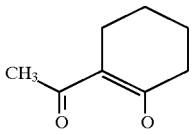 |
| MS-55 | Ni | 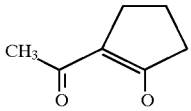 |
| MS-56 | Ni | 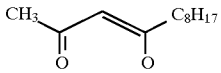 |
| MS-57 | Ni | 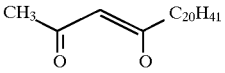 |
| MS-58 | Ni | 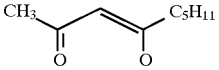 |
| MS-59 | Ni | 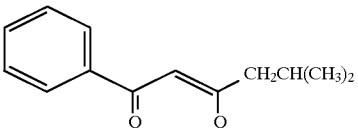 |
| MS-60 | Ni | 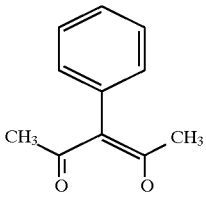 |
MS-61 to MS-67:
| Compd. No. | M | X |
|---|---|---|
| MS-61 | Ni | 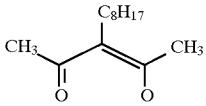 |
| MS-62 | Ni | 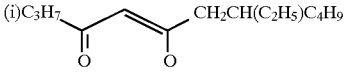 |
| MS-63 | Ni | 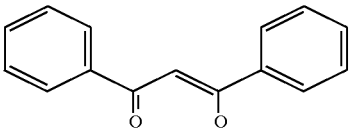 |
| MS-64 | Ni | 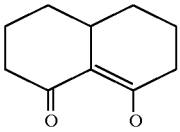 |
| MS-65 | Ni | 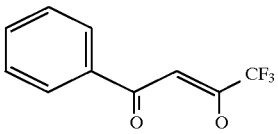 |
-continued
| Compd. No. | M | X |
|---|---|---|
| MS-66 | Ni | 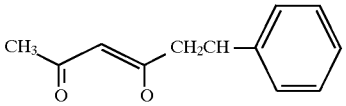 |
| MS-67 | Ni | 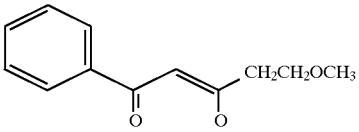 |
MS-68 to MS-74:
| Compd. No. | M | X |
|---|---|---|
| MS-68 | Ni | 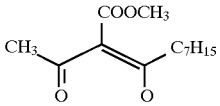 |
| MS-69 | Ni | 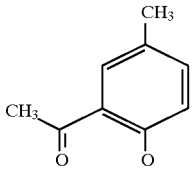 |
| MS-70 | Ni | 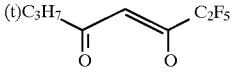 |
| MS-71 | Ni | 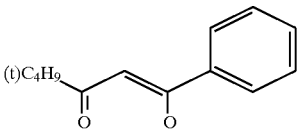 |
| MS-72 | Zn | 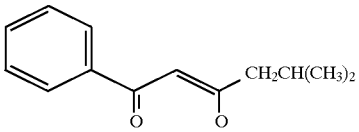 |
| MS-73 | Zn | 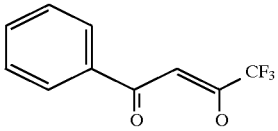 |
| MS-74 | Cu | 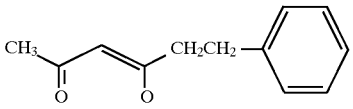 |
MS-75 to MS-81:
| Compd. No. | M | X |
|---|---|---|
| MS-75 | Cu | 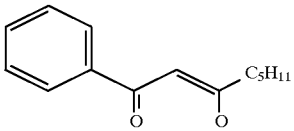 |
| MS-76 | Ni | 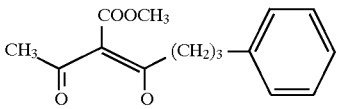 |

-continued
| Compd. No. | M | X |
|---|---|---|
| MS-77 | Ni | 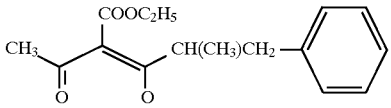 |
| MS-78 | Ni | 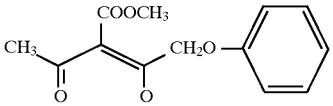 |
| MS-79 | Ni | 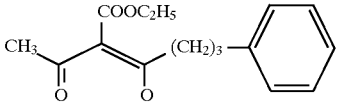 |
| MS-80 | Ni | 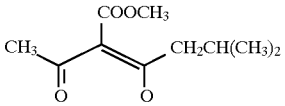 |
| MS-81 | Ni | 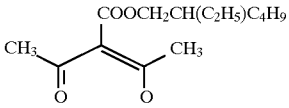 |
| MS-82 to MS-88: | | |
| MS-82 | Ni | 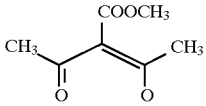 |
| MS-83 | Ni | 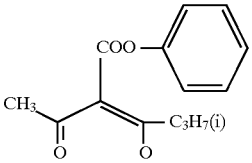 |
| MS-84 | Ni | 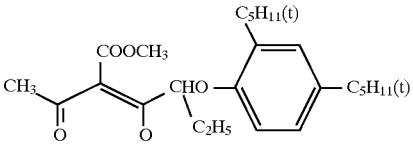 |
| MS-85 | Ni | 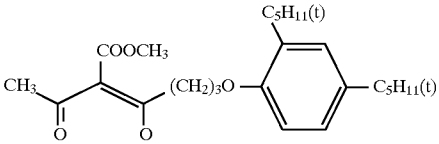 |
| MS-86 | Ni | 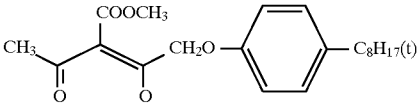 |
| MS-87 | Ni | 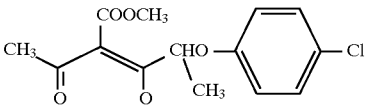 |
-continued
| Compd. No. | M | X |
|---|---|---|
| MS-88 | Ni | 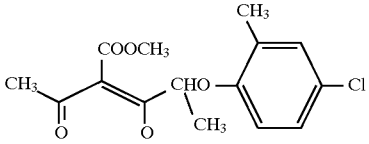 |
| MS-89 to MS-95: | | |
| MS-89 | Ni | 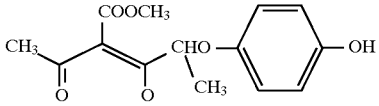 |
| MS-90 | Ni | 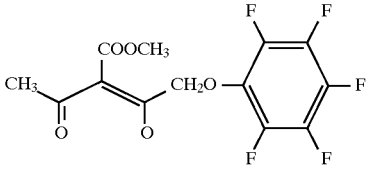 |
| MS-91 | Ni | 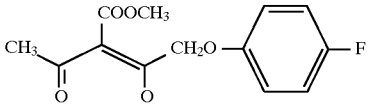 |
| MS-92 | Ni | 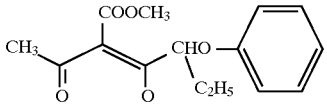 |
| MS-93 | Ni | 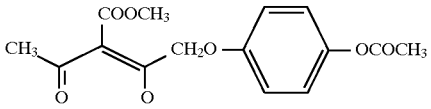 |
| MS-94 | Ni | 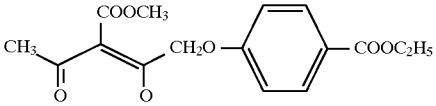 |
| MS-95 | Ni | 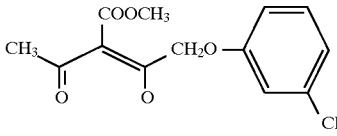 |
| MS-96 to MS-99: | | |
| MS-96 | Ni | 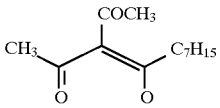 |
| MS-97 | Ni | 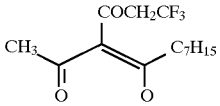 |
| MS-98 | Ni | 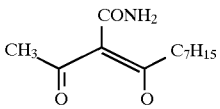 |

-continued

| Compd. No. | M | X |
|---|---|---|
| MS-99 | Ni | 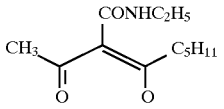 |

The metal source in the present invention is not limited to those represented by the general formulae (1) and (3).

The receptive layer 5 is formed on the substrate 4 by adding a metal source, that is, a metal ion-containing compound, and optionally additives, such as a release agent, to a binder resin and dissolving or dispersing the mixture in water or an organic solvent to prepare an ink, coating the substrate by a conventional method, such as bar coating, gravure printing, screen printing, or reverse roll coating using a gravure plate, and drying the coating.

The method for forming the receptive layer 5 cannot be limited to the above method which comprises coating an ink directly on the substrate and drying the coating. Specifically, a receptive layer 5 may be preliminarily formed on a separate substrate and then transferred onto the substrate 4. The above separate substrate may be formed of the same material as used in the substrate 4.

The thickness of the receptive layer 5 is preferably about 0.1 to 10 $\mu$m in terms of the thickness after drying the coating.

Figure 3:
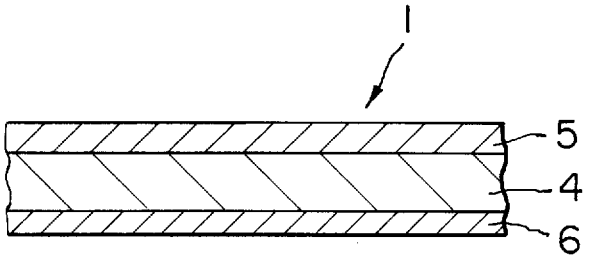
FIG. 3 is a cross-sectional view showing another embodiment of the construction of a receptive layer area.

In order to prevent heat fusing between the receptive layer area 1 and a heating device, such as a thermal head, and to improve the slipperiness, as shown in FIG. 3, a back surface layer 6 may be provided on the other surface of the substrate 4 remote from the receptive layer 5.

Back Surface Layer

Binder resins usable for the back surface layer 6 include, for example, cellulosic resins, such as ethyl cellulose, hydroxyethyl cellulose, hydroxypropyl cellulose, methyl cellulose, cellulose acetate, cellulose acetate butyrate, and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile/styrene copolymer, polyamide resins, vinyltoluene resins, coumarone/indene resins, polyester resins, polyurethane resins, and silicone-modified or fluorine-modified urethane resins.

These resins may be used as a mixture of two or more. In order to further enhance the heat resistance of the back surface layer 6, among the resins, a resin having a reactive group, such as a hydroxyl group, may be used in combination with polyisocyanate or the like as a crosslinking agent to form a crosslinked resin layer.

Further, in order to improve the slipperiness between the back surface layer 6 and a heating device, such as a thermal head, a solid or liquid release agent or lubricant may be added to impart heat-resistant lubricity. Release agents or lubricants usable herein include, for example, various waxes, such as polyethylene and paraffin waxes, higher aliphatic alcohols, organopolysiloxanes, anionic surfactants, cationic surfactants, amphoteric surfactants, nonionic surfactants, fluorosurfactants, organic carboxylic acids and derivatives thereof, fluororesins, silicone resin, and fine particles of inorganic compounds, such as talc and silica.

The content of the lubricant in the back surface layer 6 is preferably about 5 to 50% by weight, particularly preferably about 10 to 30% by weight, based on the total solid content of the back surface layer 6.

The back surface layer 6 may be formed in the same manner as used in the formation of the receptive layer 5, and the thickness thereof is preferably about 0.1 to 10 $\mu$m after drying of the coating.

Figure 4:
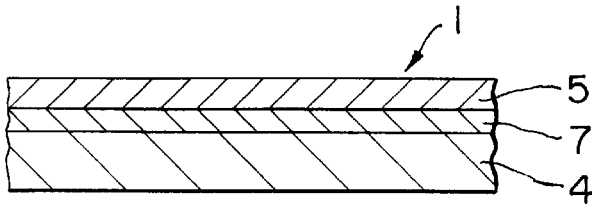
FIG. 4 is a cross-sectional view showing a further embodiment of the construction of a receptive layer area.

As shown in FIG. 4, in order to control the releasability of the receptive layer from the substrate 4, a release layer 7 may be provided between the substrate 4 and the receptive layer 5. In this case, the receptive layer 5 is separated from the release layer 7 while leaving the release layer on the substrate 4 side. The release layer 7 is formed of a composition of a binder resin with a releasable material being optionally added thereto or alternatively may be formed of a releasable resin.

Release Layer

Binder resins, with a releasable material being optionally added thereto, usable for constituting the release layer 7 include: thermoplastic resins, for example, acrylic resins, such as polymethyl methacrylate, polyethyl methacrylate, and polybutyl acrylate, vinyl resins, such as polyvinyl acetate, vinyl chloride/vinyl acetate copolymer, polyvinyl alcohol, and polyvinyl butyral, cellulose derivatives, such as ethyl cellulose, nitrocellulose, and cellulose acetate; and thermosetting resins, for example, unsaturated polyester resins, polyester resins, polyurethane resins, and aminoalkyd resins. The release layer 7 may be formed of a composition of at least one of the above resins.

Release agents usable herein include releasable resins, such as waxes, silicone wax, silicone oil, silicone resins, melamine resin, and fluororesin, fine particles of talc and silica, and lubricants such as a surfactant and a metal soap.

When the release layer 7 is formed of a releasable resin, silicone resin, melamine resin, fluororesin, and other resins may be used. It is also possible to use a graft polymer wherein a releasable segment, such as a polysiloxane segment or a carbon fluoride segment, is grafted onto a resin molecule, such as an acrylic resin, a vinyl resin, or a polyester resin. The release layer 7 may be formed of a composition of at least one of the above resins.

The release layer 7 may be formed in the same manner as used in the formation of the receptive layer 5, and the thickness thereof is preferably 0.1 to 5 $\mu$m on a dry basis.

Figure 5:
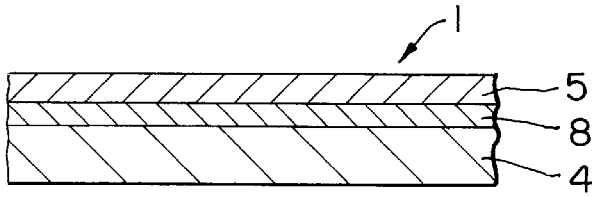
FIG. 5 is a cross-sectional view showing a yet further embodiment of the construction of a receptive layer area.

As shown in FIG. 5, a protective layer 8 may be provided between the substrate 4 and the receptive layer 5 from the viewpoint of protecting the receptive layer 5 transferred together with an image onto an object. The protective layer 8, when transferred together with the receptive layer 5 onto the object, is located on the uppermost surface of the receptive layer 5 to further improve weather resistance and resistance to fingerprints, chemicals and the like.

The protective layer 8 is formed of at least a binder resin, and a resin composition is selected which has suitable separability from the substrate 4 and, after being transferred together with the receptive layer 5, exhibits properties suitable as the surface protective layer of the receptive layer 5. In general, thermoplastic resins, for example, cellulose derivatives, such as ethyl cellulose, nitrocellulose, and cellulose acetate, acrylic resins, such as polymethyl methacrylate, polyethyl methacrylate, and polybutyl acrylate, vinyl polymers, such as polyvinyl chloride, vinyl chloride/vinyl acetate copolymer, and polyvinyl butyral, and thermosetting resins, for example, unsaturated polyester resins, polyurethane resins, and aminoalkyd resins, may be used as the resin for constituting the protective layer. When abrasion resistance, chemical resistance, and contamination resistance are particularly required of an image-formed object onto which the receptive layer 5 has been transferred, it is also possible to use an ionizing radiation-curing resin as the resin for constituting the protective layer.

Further, lubricants for improving the scratch resistance of an object with an image formed thereon, surfactants for preventing contamination, ultraviolet absorbers for improving the weather resistance, antioxidants, and the like may be added to the above resin.

The protective layer 8 may be formed in the same manner as used in the formation of the receptive layer 5, and the thickness thereof is preferably 0.1 to 20 $\mu$m after drying of the coating.

Dye Layer

According to the present invention, the dye layer area 2 is composed mainly of a thermal diffusible dye capable of forming a chelate and a binder resin.

The thermal diffusible dye usable in the present invention is not particularly limited so far as it has a group which can combine with the above polyvalent metal ion to form a complex. However, dye compounds represented by the following general formula (5) or (6) are preferred:

(5)

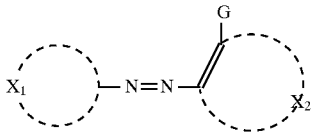

wherein $X_1$ represents a group of atoms necessary for completing an aromatic carbocyclic ring or a heterocyclic ring with at least one ring being constituted by 5 to 7 atoms, at least one atom located adjacent to carbon attached to the azo bond being (A) a carbon atom and (B) a nitrogen, oxygen, or sulfur atom, $X_2$ represents a group of atoms necessary for completing an aromatic carbocyclic ring or a heterocyclic ring with at least one ring being constituted by 5 to 7 atoms and G represents a chelating group; or (6)

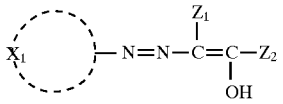

wherein $X_1$ is as defined above in connection with the general formula (5), $Z_1$ represents an electron-withdrawing group and $Z_2$ represents an aryl group.

Specific examples of thermal diffusible dyes represented by the general formulae (5) and (6) include those described in Japanese Patent Laid-Open Nos. 78893/1984, 109394/1984, and 2398/1985. They may be prepared according to a synthetic method disclosed in these publications.

Preferred yellow dyes are represented by the following formula (7):

(7)

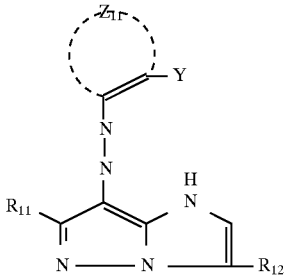

wherein $R_{11}$ and $R_{12}$ each independently represent a hydrogen atom or a substituent, $Y_1$ represents $OR_{13}$, $SR_{13}$ or $NR_{13}R_{14}$, $Z_{11}$ represents a group of atoms necessary for constituting, together with two carbon atoms, a five- or six-membered aromatic ring and $R_{13}$ and $R_{14}$ each independently represent an optionally substituted alkyl or aryl group.

Examples of the substituent represented by $R_{11}$ and $R_{12}$ include halogen atoms (such as fluorine and chlorine) and alkyl (such as methyl, i-propyl, t-butyl, trifluoromethyl, methoxymethyl, 2-methylsulfonylethyl, and 2-methanesulfonamidoethyl), cycloalkyl (such as cyclopentyl and cyclohexyl), aryl (phenyl, 3-methylphenyl, 4-t-butylphenyl, 2-methoxyphenyl, and 3-acetaminophenyl), cyano, acyl, alkoxy, aryloxy, acylamino, anilino, ureido, sulfamoylamino, alkylthio, arylthio, alkoxycarbonylamino, sulfonamido, carbamoyl, sulfamoyl, sulfonyl, alkoxycarbonyl, heterocyclic oxy, heterocyclic thio, acyloxy, carbamoyloxy, silyloxy, aryloxycarbonylamino, imide, and phosphonyl groups.

Examples of the alkyl and aryl group represented by $R_{13}$ and $R_{14}$ include those described above in connection with the definition of the alkyl and aryl groups represented by $R_{11}$ and $R_{12}$.

Five- and six-membered aromatic rings constituted by $Z_{11}$ and two carbon atoms include benzene, pyridine, pyrimidine, triazine, pyrazine, pyridazine, pyrrole, furan, thiophene, pyrazole, imidazole, triazole, oxazole, and thiazole. These rings may further combine with other aromatic ring(s) to form a condensed ring.

Preferred magenta dyes are represented by the following general formula (8):

(8)

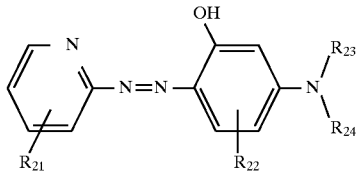

wherein $R_{21}$ represents an alkyl group or a halogen or hydrogen atom, $R_{22}$ represents an alkyl group or a hydrogen atom, $R_{23}$ and $R_{24}$ each independently represent an optionally substituted alkyl group, an optionally substituted aralkyl group, or an optionally substituted aryl group, provided that at least one of $R_{23}$ and $R_{24}$ is an alkyl-substituted aryl group or an alkyl-substituted aralkyl group.

Examples of the halogen atom represented by $R_{21}$ include chlorine and bromine, and examples of the alkyl group represented by $R_{21}$ and $R_{22}$ include methyl, ethyl, and butyl. The optionally substituted alkyl, aralkyl and aryl groups represented by $R_{23}$ and $R_{24}$ include methyl, ethyl, propyl, i-propyl, butyl, sec-butyl, pentyl, hexyl, methoxyethyl, ethoxycarbonylmethyl, benzyl, phenethyl, 4-methylbenzyl, phenyl, m-tolyl, and p-tolyl, provided that at least one of $R_{23}$ and $R_{24}$ is an alkyl-substituted aryl group (such as m-tolyl or 4-methoxyphenyl) or an alkyl-substituted aralkyl group (methylbenzyl).

Preferred cyan dyes are represented by the following general formula (9):

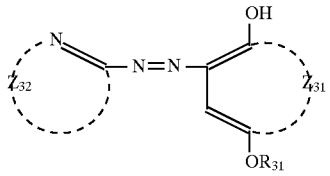

(9)

wherein $Z_{31}$ represents a group of atoms necessary for forming a substituted or unsubstituted aromatic ring, $Z_{32}$ represents a group of atoms necessary for forming a substituted or unsubstituted thiazole ring, benzothiazole ring, or pyridine ring, and $R_{31}$ represents an optionally substituted alkyl group.

Preferred examples of the aromatic ring constituted by $R_{31}$ include a benzene ring and a naphthalene ring. The optionally substituted alkyl group represented by $R_{31}$ is preferably a straight-chain or branched alkyl group having 1 to 12 carbon atoms, and examples thereof include methyl, ethyl, propyl, iso-propyl, butyl, t-butyl, hexyl, 2-ethylhexyl, decyl, methoxyethyl, chloromethyl, 2-carboxyethyl, and benzyl.

Examples of representative compounds represented by the general formulae (7), (8), and (9) include, but not limited to, the following compounds.

Examples of the yellow dye include the following Y-1 to Y-5.

Y-1 to Y-5

Y-1

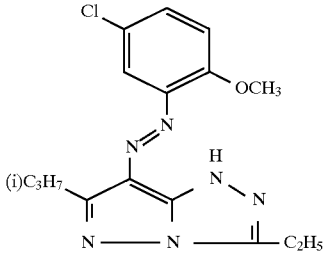

Y-1

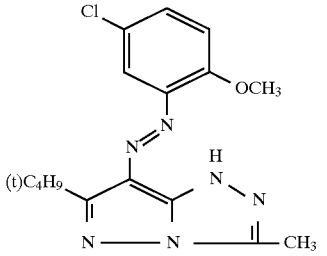

Y-2

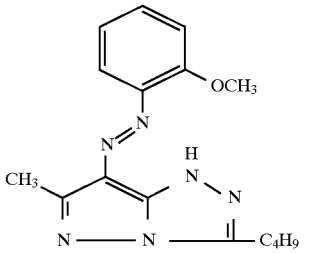

Y-3

-continued

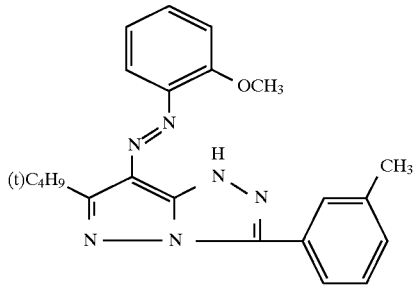

Y-4

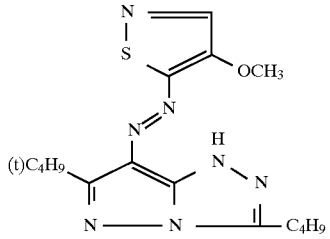

Y-5

Examples of the magenta dye include the following M-1 to M-5.

M-1 to M-5

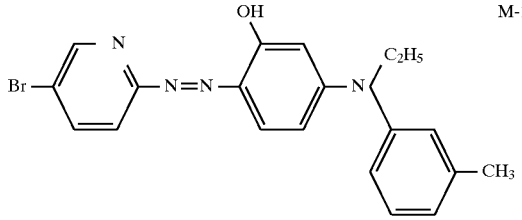

M-1

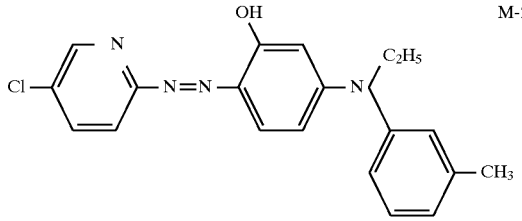

M-2

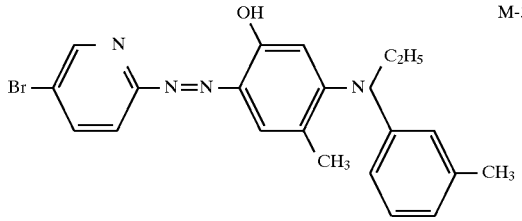

M-3

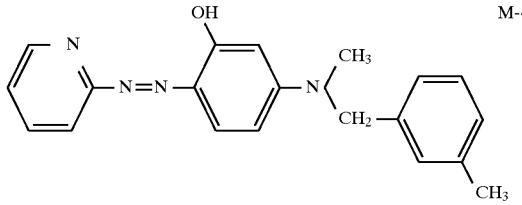

M-4

-continued

M-5

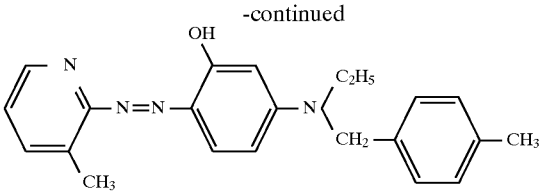

Examples of the cyan dye include the following C-1 to C-5.

C-1 to C-5

C-1

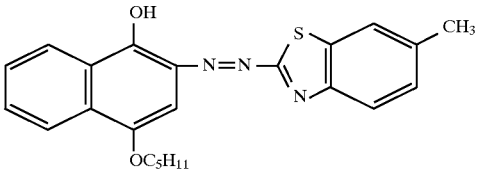

C-2

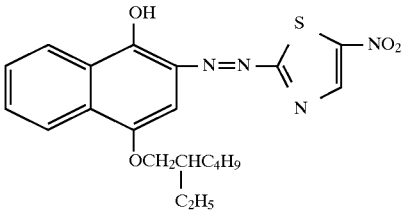

C-3

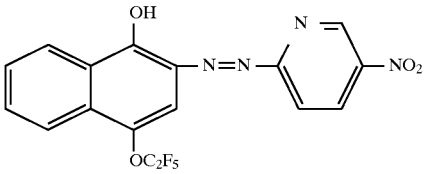

C-4

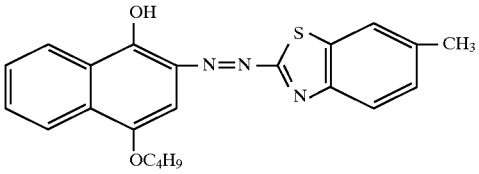

C-5

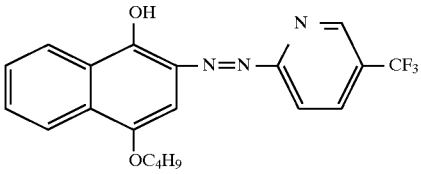

In general, the amount of the thermal diffusible dye capable of forming a chelate according to the present invention is preferably 0.1 to 20 g, more preferably 0.2 to 5 g, per $m^2$ of the dye layer.

Binder resins usable in the dye layer include cellulose, polyacrylic acid, polyvinyl alcohol, polyvinyl pyrrolidone and other water-soluble polymers, and polymers soluble in organic solvents, such as acrylic resin, methacrylic resin, polystyrene, polycarbonate, polysulfone, polyether sulfone, polyvinyl butyral, polyvinyl acetal, ethyl cellulose, and nitrocellulose. When polymers soluble in an organic solvent are used, at least one of them may be dissolved in an organic solvent. Alternatively, they may be used in the form of a latex dispersion.

The amount of the binder used is preferably 0.1 to 50 g per $m^2$ of the substrate.

The adhesive layer in the adhesive layer area 3 may be transferred by two methods, that is, a method wherein the adhesive layer alone is first transferred onto an object followed by the transfer of a receptive layer 5 with an image formed thereon and a method wherein the adhesive layer is transferred onto a receptive layer with an image formed thereon followed by the transfer of the adhesive layer together with the receptive layer 5 onto an object.

Figure 6:
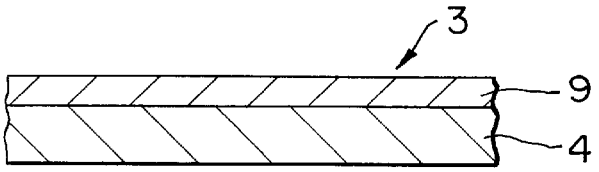
FIG. 6 is a cross-sectional view showing one embodiment of the construction of an adhesive layer area.

An example of the layer construction of the adhesive layer area 3 used in an embodiment where the adhesive layer is first transferred onto an object is shown in FIG. 6. An adhesive layer 9 is formed of a material having good adhesion to an object, such as paper. A suitable material should be selected depending upon the object. In general, however, thermoplastic synthetic resins, natural resins, rubbers, and waxes may be used. More specific examples of the material usable for constituting the adhesive layer 9 include synthetic resins, for example, cellulose derivatives, such as ethyl cellulose and cellulose acetate butyrate, styrene resins, such as polystyrene and poly-α-methylstyrene, acrylic resins, such as polymethyl methacrylate, polyethyl methacrylate, and polyethyl acrylate, vinyl resins, such as polyvinyl chloride, polyvinyl acetate, vinyl chloride/vinyl acetate copolymer, and polyvinyl butyral, polyester resins, nylon resins, epoxy resins, polyurethane resins, ionomers, ethylene/acrylic acid copolymer, and ethylene/acrylic ester copolymer; and tackifiers, such as rosin, rosin-modified maleic acid resins, ester rubber, polyisobutyrene rubber, butyl rubber, styrene/butadiene rubber, butadiene/acrylonitrile rubber, polyamide resins, and polychlorinated polyolefins. The adhesive layer 9 may be formed of a composition of at least one of the above materials.

The thickness of the adhesive layer 9 is determined so that the adhesion between the object and the receptive layer is good. In general, however, it is preferably 0.1 to 20 μm on a dry basis. Further, the adhesive layer 9 may be formed by coating and drying in the same manner as described above in connection with the formation of the receptive layer 5.

A release layer (not shown) may be provided from the viewpoint of controlling the releasability of the adhesive layer 9 from the substrate 4. In this case, the adhesive layer 9 is separated from the release layer while leaving the release layer on the substrate side.

Figure 7:
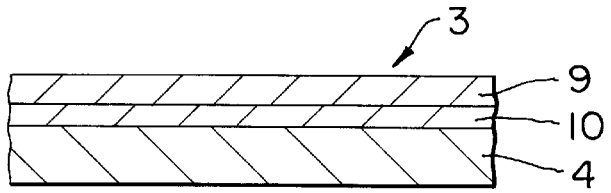
FIG. 7 is a cross-sectional view showing another embodiment of the construction of an adhesive layer area.

Further, as shown in FIG. 7, a peel layer 10 may be provided between the substrate 4 and adhesive layer 9. The peel layer 10 is separated from the substrate 4 and, together with the adhesive layer 9, transferred onto an object. After transfer onto the object, the peel layer 10 is adhered to the receptive layer 5. Therefore, the peel layer 10 is formed of the same material as used for constituting the above receptive layer 5. It may be formed by coating and drying in the same manner as described above in connection with the formation of the receptive layer 5.

Figure 8:
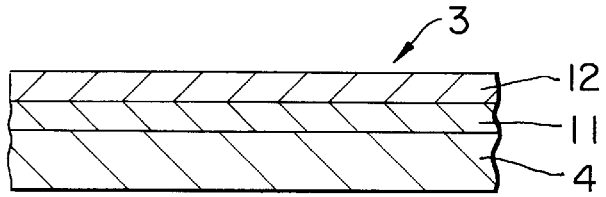
FIG. 8 is a cross-sectional view showing a further embodiment of the construction of an adhesive layer area.

An example of the layer construction of the adhesive layer area 3 used in an embodiment where the adhesive layer is first transferred onto a receptive layer 5 is shown in FIG. 8. An adhesive layer 11, for an object, which serves to adhere onto an object is provided on a substrate 4, and an adhesive layer 12, for a receptive layer, which serves to adhere to a receptive layer is provided thereon.

The adhesive layer 11 for an object is formed of the same material as used for the adhesive layer 9, while the adhesive layer 12 for a receptive layer is formed of the same material as used for the receptive layer 5.

Figure 9:
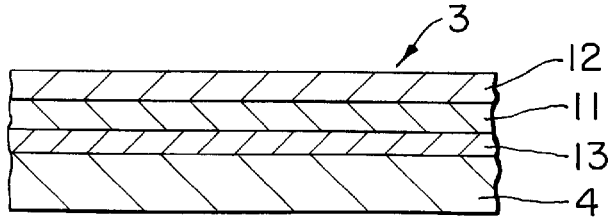
FIG. 9 is a cross-sectional view showing a yet further embodiment of the construction of an adhesive layer area.

The thickness of each of the adhesive layers 11, 12 is determined so that the adhesion between the object and the receptive layer 5 is good. In general, however, it is preferably in the range of from 0.1 to 20 μm on a dry basis. As shown in FIG. 9, a release layer 13 for an adhesive layer may be provided between the substrate 4 and the adhesive layer 11 for an object from the viewpoint of controlling the releasability of the adhesive layer 11, for an object, from the substrate 4. In this case, the adhesive layers 11, 12 are separated from the release layer 13 for an adhesive layer while leaving the release layer for an adhesive layer 13 on the substrate 4 side. The release layer 13 for an adhesive layer may be formed of the same material as used for constituting the release layer 7 between the substrate 4 and the receptive layer 5.

Besides heat-sensitive materials, pressure-sensitive materials may be used in the adhesive layer 12 for a receptive layer. Further, as described above, a back surface layer 6 may be provided on the substrate 4 in the adhesive layer area 3.

An organic pigment, an inorganic pigment and the like may be added to the receptive layer, the release layer, the protective layer, and the adhesive layer from the viewpoint of improving the transferability of the coating.

Further, in the thermal transfer material according to the present invention, in addition to the receptive layer area, the dye layer area, and the adhesive layer area, a protective layer formed of a material having ultraviolet absorption and scratch resistance may be provided on the identical substrate.

An image-forming method using a thermal transfer material having the above construction will be described with reference to the accompanying drawings.

Figure 10:
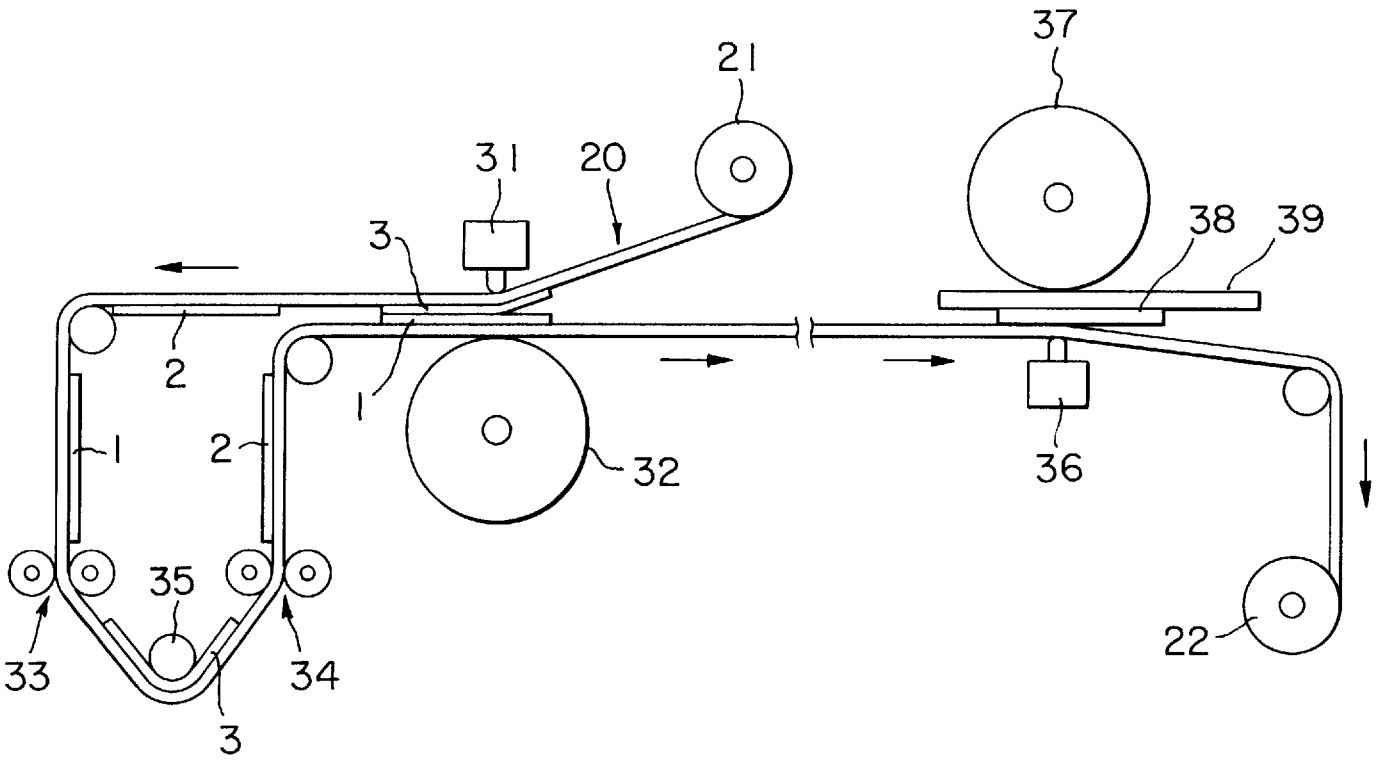
FIG. 10 is a schematic diagram showing one embodiment of the construction of a thermal transfer recording device according to the present invention.

FIG. 10 shows an embodiment of the construction of a thermal transfer recording apparatus. An integral thermal transfer material 20 comprising a receptive layer area 1, a dye layer area 2, and an adhesive layer area 3 provided in a face serial manner on an identical substrate is used in this embodiment. In the drawing, since the thermal transfer material 20 is schematically shown, the length or the like of each area in the thermal transfer material 20 is different from the actual one.

The thermal transfer material 20 is fed from a feed roll 21 and carried in a direction indicated by an arrow in the drawing by winding the material 20 on a take-up roll 22. The thermal transfer material 20 is carried with the receptive layer area 1, the dye layer area 2, and the adhesive layer area 3 facing inward and pressed and heated by means of a first thermal head 31 and a first platen roll 32 to transfer a dye layer and an adhesive layer onto a receptive layer. At the time of the transfer, the thermal transfer material 20 is carried in the left direction in the drawing by means of the first and second carrier rolls 33, 34. A slack of the thermal transfer material 20 is removed by means of a vertically movable roll 35 to prevent the creation of a cockle. A tension control mechanism is provided between the drive mechanism of the feed roll 21 or the first thermal head 31 and the feed roll 21 or between the drive mechanism of the take-up roll 22 or the first platen roll 32 and the take-up roll 22 so that back tension is applied at the time of transfer. Conversely, the apparatus may be constructed so that the thermal transfer material 20 is carried in the right direction of the drawing at the time of transfer and back tension is applied by the vertically movable roll 35. Further, a detection mark may be provided at the head of each area in order to detect the position of the receptive layer area 1, the dye layer area 2, and the adhesive layer area 3. Subsequently, the receptive layer 38 onto which an adhesive layer with an image formed thereon has been transferred is transferred onto an object 39 by means of a second thermal head 36 and a second platen roll 37. The adhesive layer area in the thermal transfer material 20 used in the formation of an image on the object 39 by the above method has a layer construction as shown in FIG. 8 or FIG. 9.

The apparatus having a construction shown in FIG. 10 may be designed so that, after the formation of an image on the receptive layer by means of the first thermal head 31 and the first platen roll 32, an adhesive layer is first transferred onto an object 39 by means of a second thermal head 36 and a second platen roll 37 and an image-bearing receptive layer is transferred thereon. The adhesive layer area in the thermal transfer material 20 used in the formation of an image on the object 39 by this method has a layer construction shown in FIG. 6 or 7.

Figure 11:
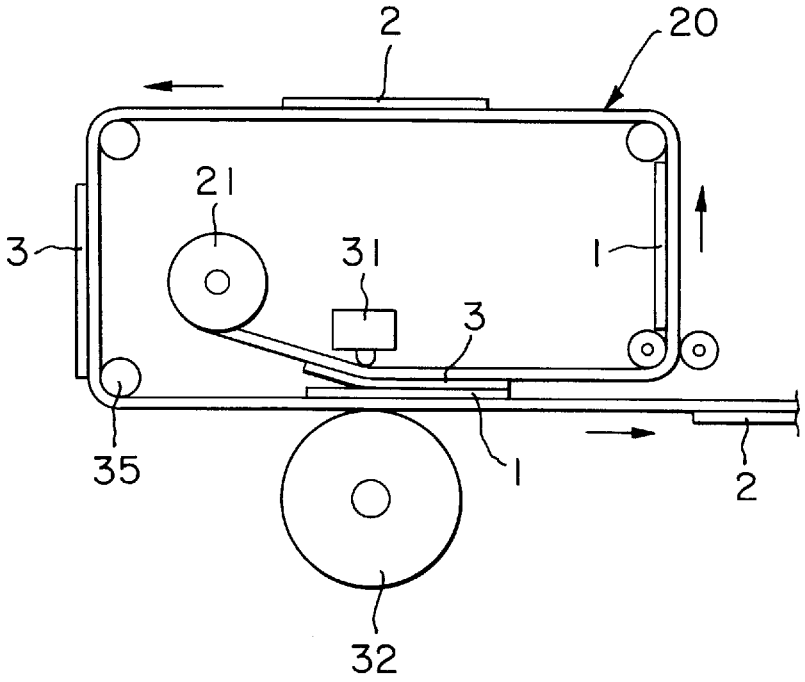
FIG. 11 is a schematic diagram showing another embodiment of the construction of a thermal transfer recording device according to the present invention.

FIG. 11 shows another embodiment of the construction of a thermal transfer recording apparatus. An integral thermal transfer material 20 comprising only a receptive layer area 1 on one surface of the substrate and a dye layer area 2 and an adhesive layer area 3 provided on the other surface of the substrate is used in this embodiment. In this drawing, the transfer section wherein the transfer onto an object is performed is omitted. Further, in this drawing as well, since the thermal transfer material 20 is schematically shown, the length or the like of each area in the thermal transfer material 20 is different from the actual one.

The thermal transfer material 20 is fed from a feed roll 21 and carried in a direction indicated by an arrow in the drawing. It is carried with the receptive layer area 1 facing inward and pressed and heated by means of a first thermal head 31 and a first platen roll 32 to transfer a dye layer and an adhesive layer onto the receptive layer. At the time of the transfer, the thermal transfer material 20 is carried in a pressed and heated state in the left direction or the right direction by means of a carrier roll (not shown). A transversely movable roll 35 removes a slack of the thermal transfer material 20 to prevent the creation of a cockle or the like and, at the same time, functions to regulate the length. In addition, the transversely movable roll can regulate the tension at the time of transfer, and the provision of a detection mark at the head of each area in the receptive layer area 1, the dye layer area 2, and the adhesive layer area 3 enables more accurate registration. After the transfer of the dye layer and the adhesive layer onto the receptive layer, the receptive layer with an image formed thereon is transferred onto an object in a transfer section (not shown). The adhesive layer area in the thermal transfer material used in this method has a layer construction shown in FIG. 8 or 9.

According to a further embodiment of the present invention, an integral thermal transfer material, wherein a receptive layer area and an adhesive layer area are provided in a face serial manner on an identical plane with only a dye layer area being provided on the other surface of the substrate, is used, and, as with the embodiment shown in FIG. 11, the thermal transfer material is carried with the receptive layer area facing inward. In this case, after the formation of an image on a receptive layer by means of the first thermal head 31 and the first platen roll 32, an adhesive layer may be first transferred onto an object followed by the transfer of the image-bearing receptive layer onto the adhesive layer. The adhesive layer area in the thermal transfer material used in this method has a layer construction shown in FIG. 6 or 7.

At the time of transfer of the dye onto a receptive layer, thermal energy may be applied by any conventional means. The application of the thermal energy may be performed through the back surface of the dye layer area or through the back surface of the receptive layer area to transfer the dye. Also in the case of transfer of the adhesive layer, the thermal energy may be applied through the back surface of the adhesive layer area or through the back surface of an element onto which the adhesive layer is to be transferred.

There is a mirror image relationship between a finally formed image and an image formed on the receptive layer. Therefore, regarding the image formed on the respective layer, a reverse image should be previously formed.

The present invention will be described in more detail with reference to the following examples.

EXAMPLE 1

A 12 μm-thick polyethylene terephthalate film having a treated back surface (Lumirror, manufactured by Toray Industries, Inc.) was provided as a substrate, and a coating liquid, for a protective layer, having the following composition was coated on the surface of the substrate remote from the back surface thereof at a coverage of 2 g/m$^2$ on a dry basis. Then, a coating liquid, for a receptive layer, having the following composition containing a metal source was coated thereon at a coverage of 2 g/m$^2$ on a dry basis, and the coating was dried at 100° C. for 5 min, thereby forming a receptive layer area.

| [Composition of coating liquid for protective layer] | |
|---|---|
| Polymethyl methacrylate (BR-83, manufactured by Mitsubishi Rayon Co., Ltd.) | 100 parts by weight |
| Methyl ethyl ketone | 500 parts by weight |
| [Metal source] | |
| Compound No. MS-68 listed above | |
| [Composition of coating liquid for receptive layer] | |
| Vinyl chloride/vinyl acetate copolymer resin (VYHD, manufactured by Union Carbide Corp.) | 100 parts by weight |
| Metal source (Compound No. MS-68 listed above) | 20 parts by weight |
| Epoxy-modified silicone (KF-393, manufactured by The Shin-Etsu Chemical Co., Ltd.) | 1 part by weight |
| Amino-modified silicone (KS-343, manufactured by The Shin-Etsu Chemical Co., Ltd.) | 1 part by weight |
| Methyl ethyl ketone | 250 parts by weight |
| Toluene | 250 parts by weight |

Then, a coating liquid, for a peel layer, having the following composition was coated on the surface of the same substrate, remote from the back surface thereof and in an area different from the receptive layer area, at a coverage of 1 g/m$^2$ on a dry basis, and a coating liquid, for an adhesive layer, having the following composition was further coated thereon, followed by drying of the coating at 100° C. for 5 min to form a transfer area for an adhesive layer.

| [Composition of coating liquid for peel layer] | |
|---|---|
| Vinyl chloride/vinyl acetate copolymer resin (1000A, manufactured by Denki Kagaku Kogyo K.K.) | 100 parts by weight |
| Methyl ethyl ketone | 500 parts by weight |
| [Composition of coating liquid for adhesive layer] | |
| Polyamide resin (Macromelt 6240, manufactured by Henkel Hakusui Co., Ltd.) | 100 parts by weight |
| Methyl ethyl ketone | 500 parts by weight |

Further, dye layers of YMC respectively containing thermal diffusible dyes which can form a chelate (Y-1, M-1, and C-1) were provided on the surface of the same substrate remote from the back surface thereof and in an area different from the receptive layer area and the adhesive layer area in a face serial manner to form a dye layer area. Thus, an integral thermal transfer sheet was prepared. Coating liquids for the dye layers had the following compositions.

| [Composition of coating liquid for yellow dye layer] | |
|---|---|
| Yellow dye (Compound No. Y-1 listed above) | 4 parts by weight |
| Polyvinyl butyral resin | 70 parts by weight |
| Methyl ethyl ketone | 13 parts by weight |
| Toluene | 13 parts by weight |
| [Composition of coating liquid for magenta dye layer] | |
| Magenta dye (Compound No. M-1 listed above) | 4 parts by weight |
| Polyvinyl butyral resin | 70 parts by weight |
| Methyl ethyl ketone | 13 parts by weight |
| Toluene | 13 parts by weight |
| [Composition of coating liquid for cyan dye layer] | |
| Cyan dye (Compound No. C-1 listed above) | 4 parts by weight |
| Polyvinyl butyral resin | 70 parts by weight |
| Methyl ethyl ketone | 13 parts by weight |
| Toluene | 13 parts by weight |

For the thermal transfer materials thus prepared, the receptive layer and the dye layer were put on top of the other. The laminate was pressed by means of a thermal head, having a resolution of 12 dots/mm and an average resistance of 3100Ω, and a platen roll and heated through the back surface of the dye layer area in a step pattern with the applied energy being successively increased in the range of from 5 to 80 mJ/mm$^2$ at a feed rate of 10 msec/line to form an image on the receptive layer.

Subsequently, a commercially available wood-free paper was put on top of the adhesive layer area in the thermal transfer material, and the laminate was pressed by means of a thermal head and a platen roll of the same types as described above and heated through the back surface of the adhesive layer area under conditions of applied energy 80 mJ/mm$^2$ and feed rate 10 msec/line to transfer the adhesive layer and the peel layer separated from the substrate onto the wood-free paper.

The wood-free paper having transferred adhesive layer and peel layer was put on top of the receptive layer with an image formed thereon, and the laminate was pressed by means of a thermal head and a platen roll of the same types as described above and heated through the back surface of the receptive layer area under conditions of applied energy 80 mJ/mm$^2$ and feed rate 10 msec/line to adhere the peel layer, on the wood-free paper, to the receptive layer. Thereafter, the receptive layer, together with the protective layer, was separated from the substrate to prepare an object with an image formed thereon.

The image on the wood-free paper thus obtained was free from unevenness, bleeding, and dropout for each density of the step pattern by virtue of even transfer of the colorant.

EXAMPLE 2

The procedure of Example 1 was repeated to form a receptive layer area. A coating liquid, for a release layer, having the following composition was then coated on the surface of the same substrate, remote from the back surface thereof and in an area different from the receptive layer area, at a coverage of 1 g/m$^2$ on a dry basis. An adhesive layer for an object was coated thereon at a coverage of 3 g/m$^2$ on a dry basis using the same coating liquid as used in the formation of the adhesive layer in Example 1 in the same manner as in Example 1. A coating liquid, for an adhesive layer for a receptive layer, having the following composition was then coated on the adhesive layer, for an object, at a coverage of 4 g/m$^2$ on a dry basis, and the coating was dried at 100° C. for 5 min, thereby forming an adhesive layer area.

| [Composition of coating liquid for release layer] | |
|---|---|
| Polyurethane resin (Crisvon 9004, manufactured by Dainippon Ink and Chemicals, Inc.) | 100 parts by weight |
| Epoxy-modified silicone (KF-393, manufactured by The Shin-Etsu Chemical Co., Ltd.) | 5 parts by weight |
| [Composition of coating liquid for adhesive layer for receptive layer] | |
| Vinyl chloride/vinyl acetate copolymer resin (1000A, manufactured by Denki Kagaku Kogyo K.K.) | 100 parts by weight |
| Methyl ethyl ketone | 500 parts by weight |

Further, dye layers were provided in a face serial manner in the same manner as in Example 1 to form a dye layer area. Thus, an integral thermal transfer material was prepared.

For the thermal transfer materials thus prepared, the receptive layer and the dye layer were put on top of the other. The laminate was pressed by means of a thermal head, having a resolution of 12 dots/mm and an average resistance of 3100Ω, and a platen roll and heated through the back surface of the dye layer area in a step pattern with the applied energy being successively increased in the range of from 5 to 80 mJ/mm$^2$ at a feed rate of 10 msec/line to form an image on the receptive layer.

Subsequently, the thermal transfer material and the receptive layer with an image formed thereon were put on top of the other so that the adhesive layer area faced the receptive layer with an image formed thereon. The laminate was pressed by means of a thermal head and a platen roll of the same types as described above and heated through the back surface of the adhesive layer area under conditions of applied energy 80 mJ/mm$^2$ and feed rate 10 msec/line to transfer the adhesive layer for a receptive layer and the adhesive layer, for an object, separated from the release layer onto the receptive layer.

Thereafter, a commercially available wood-free paper and the receptive layer area, in the thermal transfer material, with an image being formed thereon and the adhesive layer for a receptive layer and the adhesive layer for an object being transferred thereon were put on top of the other, and the laminate was pressed by means of a thermal head and a platen roll of the same types as described above and heated through the back surface of the receptive layer area under conditions of applied energy 80 mJ/mm$^2$ and feed rate 10 msec/line to adhere the wood-free paper to the adhesive layer for an object. Thereafter, the receptive layer, together with the protective layer, was separated from the substrate to prepare an object with an image formed thereon.

As with the image formed in Example 1, the image on the wood-free paper thus obtained was free from unevenness, bleeding, and dropout for each density of the step pattern by virtue of even transfer of the colorant.

COMPARATIVE EXAMPLE 1

A 12 μm-thick polyethylene terephthalate film having a treated back surface (Lumirror, manufactured by Toray Industries, Inc.) was provided as a substrate, and a coating liquid, for a protective layer, having the following composition was coated on the surface of the substrate remote from the back surface thereof at a coverage of 2 g/m$^2$ on a dry basis. Then, a coating liquid, for a receptive layer, having the following composition was coated thereon at a coverage of 2 g/m$^2$ on a dry basis, and the coating was dried at 100° C. for 5 min, thereby forming a receptive layer area.

| [Composition of coating liquid for protective layer] | |
|---|---|
| Polymethyl methacrylate (BR-83, manufactured by Mitsubishi Rayon Co., Ltd.) | 100 parts by weight |
| Methyl ethyl ketone | 500 parts by weight |
| [Composition of coating liquid for receptive layer] | |
| Vinyl chloride/vinyl acetate copolymer resin (VYHD, manufactured by Union Carbide Corp.) | 100 parts by weight |
| Epoxy-modified silicone (KF-393, manufactured by The Shin-Etsu Chemical Co., Ltd.) | 1 part by weight |
| Amino-modified silicone (KS-343, manufactured by The Shin-Etsu Chemical Co., Ltd.) | 1 part by weight |
| Methyl ethyl ketone | 500 parts by weight |

Then, a coating liquid, for a peel layer, having the following composition was coated on the surface of the same substrate, remote from the back surface thereof and in an area different from the receptive layer area, at a coverage of 1 g/m$^2$ on a dry basis, and a coating liquid, for an adhesive layer, having the following composition was coated thereon at a coverage of 3 g/m$^2$ on a dry basis, followed by drying of the coating at 100° C. for 5 min, thereby forming a transfer area for an adhesive layer.

| [Composition of coating liquid for peel layer] | |
|---|---|
| Vinyl chloride/vinyl acetate copolymer resin (1000A, manufactured by Denki Kagaku Kogyo K.K.) | 100 parts by weight |
| Methyl ethyl ketone | 500 parts by weight |
| [Composition of coating liquid for adhesive layer] | |
| Polyamide resin (Macromelt 6240, | 100 parts by |

-continued

| | |
|---|---|
| manufactured by Henkel Hakusui Co., Ltd.) | weight |
| Methyl ethyl ketone | 500 parts by weight |

Further, dye layers of YMC were provided on the surface of the same substrate remote from the back surface thereof and in an area different from the receptive layer area and the adhesive layer area in a face serial manner to form a dye layer area. Thus, an integral thermal transfer material was prepared.

For the thermal transfer materials thus prepared, the receptive layer area and the dye layer area were put on top of the other. The laminate was pressed by means of a thermal head, having a resolution of 12 dots/mm and an average resistance of 3100Ω, and a platen roll and heated through the back surface of the dye layer area in a step pattern with the applied energy being successively increased in the range of from 5 to 80 mJ/mm$^2$ at a feed rate of 10 msec/line to form an image on the receptive layer.

Subsequently, a commercially available wood-free paper was put on top of the adhesive layer area in the thermal transfer material, and the laminate was pressed by means of a thermal head and a platen roll of the same types as described above and heated through the back surface of the adhesive layer area under conditions of applied energy 80 mJ/mm$^2$ and feed rate 10 msec/line to transfer the adhesive layer and the peel layer separated from the substrate onto the wood-free paper.

The wood-free paper having transferred adhesive layer and peel layer was put on top of the receptive layer with an image formed thereon, and the laminate was pressed by means of a thermal head and a platen roll of the same types as described above and heated through the back surface of the receptive layer area under conditions of applied energy 80 mJ/mm$^2$ and feed rate 10 msec/line to adhere the peel layer, on the wood-free paper, to the receptive layer. Thereafter, the receptive layer, together with the protective layer, was separated from the substrate to prepare an object with an image formed thereon.

COMPARATIVE EXAMPLE 2

The procedure of Example 1 was repeated to form a receptive layer area. A coating liquid, for a release layer, having the following composition was then coated on the surface of the same substrate, remote from the back surface thereof and in an area different from the receptive layer area, at a coverage of 1 g/m$^2$ on a dry basis. An adhesive layer for an object was coated thereon at a coverage of 3 g/m$^2$ on a dry basis using the same coating liquid as used in the formation of the adhesive layer in Example 1 in the same manner as in Example 1. A coating liquid, for an adhesive layer for a receptive layer, having the following composition was then coated, on the adhesive layer for an object, at a coverage of 4 g/m$^2$ on a dry basis, and the coating was dried at 100° C. for 5 min, thereby forming an adhesive layer area.

[Composition of coating liquid for release layer]

| | |
|---|---|
| Polyurethane resin (Crisvon 9004, manufactured by Dainippon Ink and Chemicals, Inc.) | 100 parts by weight |
| Dimethylformamide | 300 parts by weight |
| Epoxy-modified silicone (KF-393, manufactured by The Shin-Etsu Chemical Co., Ltd.) | 5 parts by weight |

[Composition of coating liquid for adhesive layer for receptive layer]

| | |
|---|---|
| Vinyl chloride/vinyl acetate copolymer resin (1000A, manufactured by Denki Kagaku Kogyo K.K.) | 100 parts by weight |
| Methyl ethyl ketone | 500 parts by weight |

Further, dye layers were provided in a face serial manner in the same manner as in Example 1 to form a dye layer area. Thus, an integral thermal transfer material was prepared.

For the thermal transfer materials thus prepared, the receptive layer and the dye layer were put on top of the other. The laminate was pressed by means of a thermal head, having a resolution of 12 dots/mm and an average resistance of 3100Ω, and a platen roll and heated through the back surface of the dye layer area in a step pattern with the applied energy being successively increased in the range of from 5 to 80 mJ/mm$^2$ at a feed rate of 10 msec/line to form an image on the receptive layer.

Subsequently, the thermal transfer material and the receptive layer with an image formed thereon were put on top of the other so that the adhesive layer area faced the receptive layer with an image formed thereon. The laminate was pressed by means of a thermal head and a platen roll of the same types as described above and heated through the back surface of the adhesive layer area under conditions of applied energy 80 mJ/mm$^2$ and feed rate 10 msec/line to transfer the adhesive layer for a receptive layer and the adhesive layer, for an object, separated from the release layer onto the receptive layer.

Thereafter, a commercially available wood-free paper and the receptive layer area, in the thermal transfer material, with an image being formed thereon and the adhesive layer for a receptive layer and the adhesive layer for an object being transferred thereon were put on top of the other, and the laminate was pressed by means of a thermal head and a platen roll of the same types as described above and heated through the back surface of the receptive layer area under conditions of applied energy 80 mJ/mm$^2$ and feed rate 10 msec/line to adhere the wood-free paper to the adhesive layer for an object. Thereafter, the receptive layer, together with the protective layer, was separated from the substrate to prepare an object with an image formed thereon.

The images thus formed were evaluated for light fastness, dropout, and bleeding by the following methods. The results are summarized in Table 1.

Evaluation of Light Fastness

The images formed in the examples and the comparative examples were exposed to light using a xenon fadeometer (Ci35A, manufactured by Atlas) under conditions of 50° C. (black panel temperature), irradiation time 50 hr, and 50 KLux, and the presence or absence of discoloration or fading was determined. The recording density was measured with a densitometer RD-918 manufactured by Mcbeth U.S.A., and the retention at a reflection density of about 1.0 was measured.

Evaluation of Dropout

The dropout was evaluated by visual inspection according to the following criteria.

Evaluation criteria

○: The surface of the image was smooth, and no fiber texture of the plain paper was observed in the image per se.

X: The influence of fiber texture of the plain paper appeared in the image, and the creation of a streak pattern having a higher density than the area around the pattern or a streak pattern having a lower density than the area around the pattern was observed.

Evaluation of Bleeding

Bleeding at the time of transfer of the receptive layer was evaluated by visual inspection according to the following criteria.

Evaluation criteria

○: Substantially no bleeding of dots was observed, and the sharpness of the image was not substantially lost.

X: Bleeding of dots was observed, and the sharpness of the image was lost.

TABLE 1

| | Light fastness (retention) | Dropout | Bleeding |
|---|---|---|---|
| Ex. 1 | 92% | ○ | ○ |
| Ex. 2 | 91% | ○ | ○ |
| Comp. Ex. 1 | 74% | ○ | x |
| Comp. Ex. 2 | 75% | ○ | x |

According to the present invention, a receptive layer is separably provided on one surface of the substrate. By virtue of this constitution, the formation of a sublimation-transferred image on the receptive layer, followed by heating through the other surface of the substrate remote from the receptive layer by means of a thermal head, a hot stamper or the like enables an image having neither dropouts nor unevenness to be formed on any desired object in its desired place and any desired image size.

Further, the thermal diffusible dye can be completely chelated in such a manner that the metal ion-containing compound contained in the receptive layer and the thermal diffusible dye, capable of forming a chelate, contained in the dye layer are chelated with each other upon heating in the formation of a sublimation-transferred image onto the receptive layer, and the remaining thermal diffusible dye which has not been chelated is then chelated upon heating in the transfer of the image-bearing receptive layer onto an object. Thus, a thermal transfer material, which can form an image free from bleeding and excellent in stabilities, that is, light fastness and fixability, and an image-forming method using the same are provided.

What is claimed is:

1. A thermal transfer material comprising: a substrate; and a receptive layer separably provided on one surface of the substrate, the receptive layer containing a metal ion-containing compound.

2. The thermal transfer material according to claim 1, wherein the metal ion-containing compound contained in the receptive layer is at least one member selected from the group consisting of compounds represented by the following general formulae (1) and (3):

$$M^{2+}(X)_n 2Y^- \quad (1)$$

wherein $M^{2+}$ represents a divalent transition metal ion, X represents a coordinating compound capable of coordinating to the transition metal ion $M^{2+}$ to form a complex and n is an integer of 2 or 3, provided that a plurality of coordinating compounds X may be the same or different, and $Y^-$ represents a counter ion for the transition metal ion $M^{2+}$; and $$M^{2+}(X^-)_2 \quad (3)$$

wherein $M^{2+}$ is a divalent transition metal ion and X is as defined above in connection with the formula (1), provided that the compound represented by the general formula (3) may have a neutral ligand depending upon the metal located in the center of the compound.

3. The thermal transfer material according to claim 1, which further comprises a dye layer containing a thermal diffusible dye capable of forming a chelate, the dye layer being provided on the surface of the substrate so as to have a side by side relationship with the receptive layer.

4. The thermal transfer material according to claim 3, wherein the thermal diffusible dye contained in the dye layer and capable of forming a chelate is at least one dye selected from the group consisting of compounds represented by the following general formulae (5) and (6):

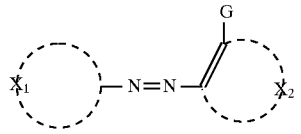

(5)

wherein $X_1$ represents a group of atoms necessary for completing an aromatic carbocyclic ring or a heterocyclic ring with at least one ring being constituted by 5 to 7 atoms, at least one atom located adjacent to carbon attached to the azo bond being (A) a carbon atom and (B) a nitrogen, oxygen, or sulfur atom, $X_2$ represents a group of atoms necessary for completing an aromatic carbocyclic ring or a heterocyclic ring with at least one ring being constituted by 5 to 7 atoms and G represents a chelating group; and

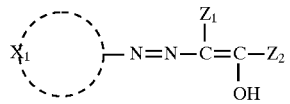

(6)

wherein $X_1$ is as defined in connection with the general formula (5), $Z_1$ represents an electron-withdrawing group and $Z_2$ represents an aryl group.

5. The thermal transfer material according to claim 1, wherein a release layer is provided between the substrate and the receptive layer.

6. The thermal transfer material according to claim 1, wherein a back surface layer is provided on the other surface of the substrate remote from the receptive layer.

7. An image-forming method comprising the steps of: putting a thermal transfer material, comprising a substrate and a receptive layer separably provided on one surface of the substrate, on a dye layer so that the receptive layer comes into contact with the dye layer; heating the laminate to form an image on the receptive layer; and transferring the receptive layer with an image formed thereon onto an object, wherein the receptive layer contains a metal ion-containing compound and the dye layer contains a thermal diffusible dye capable of forming a chelate.

* * * * *